US008997419B1

(12) United States Patent
Masanek, Jr. et al.

(10) Patent No.: US 8,997,419 B1
(45) Date of Patent: Apr. 7, 2015

(54) MODULAR FLOOR TILE SYSTEM WITH EXPANSION JOINT

(71) Applicant: MacNeil IP LLC, Bolingbrook, IL (US)

(72) Inventors: Frederick W. Masanek, Jr., Barrington, IL (US); David F. MacNeil, Hinsdale, IL (US)

(73) Assignee: MacNeil IP LLC, Bolingbrook, IL (US)

( * ) Notice: Subject to any disclaimer, the term of this patent is extended or adjusted under 35 U.S.C. 154(b) by 0 days.

(21) Appl. No.: 14/606,144

(22) Filed: Jan. 27, 2015

Related U.S. Application Data

(62) Division of application No. 13/940,468, filed on Jul. 12, 2013, now Pat. No. 8,973,328.

(51) Int. Cl.

| | |
|---|---|
| ***E04F 15/14*** | (2006.01) |
| ***E04F 15/02*** | (2006.01) |
| ***E04C 2/30*** | (2006.01) |
| *E04C 2/00* | (2006.01) |

(52) U.S. Cl.
CPC ..... *E04F 15/02011* (2013.01); *E04C 2/30* (2013.01); *E04F 15/02022* (2013.01); *E04C 2002/004* (2013.01); *E04F 2201/08* (2013.01); *E04F 2203/04* (2013.01); *E04F 2290/00* (2013.01)

(58) Field of Classification Search
CPC ..... E04F 15/02; E04F 15/02005; E04F 15/02011; E04F 15/02022; E04F 13/0889; E04F 2201/0115; E04F 2201/03; E04B 1/68; E04B 1/681; E04B 1/6804; E04C 2/30
USPC ..... 52/592.1, 393, 394, 402, 395, 396.1, 52/578; 14/73.5; 404/74
See application file for complete search history.

(56) References Cited

U.S. PATENT DOCUMENTS

| | | | |
|---|---|---|---|
| 348,782 | A | 9/1886 | Sawyer |
| 1,925,271 | A | 9/1933 | Miller |
| 1,978,283 | A | 10/1934 | Rew |

(Continued)

FOREIGN PATENT DOCUMENTS

| | | | |
|---|---|---|---|
| EP | 1077297 | A2 | 2/2001 |
| EP | 1418290 | A1 | 12/2004 |

(Continued)

OTHER PUBLICATIONS

United States Patent and Trademark Office Acting as ISA, International Search Report and Written Opinion of the ISA issued in connection with International Application No. PCT/US2010/054515 on Feb. 18, 2011.

(Continued)

*Primary Examiner* — Brent W Herring
(74) *Attorney, Agent, or Firm* — Perkins IP Law Group LLC; Jefferson Perkins

(57) ABSTRACT

A flooring system includes polymeric modular floor tiles and at least one polymeric expansion joint. The modular floor tiles are affixed to each other, and to first and second expansion bodies of the expansion joint, by mating first and second connectors. The first and second expansion bodies each have interdigitated fingers and channels that extend underneath the expansion body web. The fingers of one expansion body slide in and out of the channels in the other, accommodating the thermal expansion and contraction of the modular floor tiles proximately or remotely joined to the expansion joint.

19 Claims, 9 Drawing Sheets

(56) References Cited

U.S. PATENT DOCUMENTS

| | | | | |
|---|---|---|---|---|
| 2,181,018 | A * | 11/1939 | Hughes et al. | 404/47 |
| 2,627,744 | A | 2/1953 | Lopina | |
| 3,077,426 | A | 2/1963 | Johnston | |
| 3,165,986 | A * | 1/1965 | Hirst et al. | 404/47 |
| 3,192,097 | A | 6/1965 | Abernethy | |
| 3,676,971 | A | 7/1972 | Dombroski | |
| 3,677,145 | A * | 7/1972 | Wattiez | 404/47 |
| 3,699,926 | A | 10/1972 | Stockl | |
| 3,846,945 | A | 11/1974 | Roby | |
| 3,909,996 | A | 10/1975 | Ettlinger, Jr. et al. | |
| 3,946,529 | A | 3/1976 | Chevaux | |
| 4,054,987 | A | 10/1977 | Forlenza | |
| 4,087,948 | A | 5/1978 | Mellor | |
| 4,111,585 | A | 9/1978 | Mascaro | |
| 4,167,599 | A | 9/1979 | Nissinen | |
| 4,169,339 | A | 10/1979 | See | |
| 4,295,315 | A | 10/1981 | Lynn-Jones et al. | |
| 4,436,779 | A | 3/1984 | Menconi et al. | |
| 4,504,170 | A | 3/1985 | Schukolinski | |
| 4,590,731 | A | 5/1986 | DeGooyer | |
| 4,616,954 | A | 10/1986 | Taga | |
| 4,663,903 | A | 5/1987 | Ellingson, Jr. | |
| 4,860,510 | A | 8/1989 | Kotler | |
| 4,893,448 | A | 1/1990 | McCormick | |
| 4,930,286 | A | 6/1990 | Kotler | |
| 5,028,168 | A | 7/1991 | Conversy | |
| 5,172,533 | A | 12/1992 | Face, Jr. | |
| 5,228,253 | A | 7/1993 | Wattelez | |
| 5,295,341 | A | 3/1994 | Kajiwara | |
| 5,364,204 | A | 11/1994 | MacLeod | |
| 5,628,160 | A | 5/1997 | Kung | |
| 5,950,378 | A | 9/1999 | Council et al. | |
| 5,992,106 | A | 11/1999 | Carling et al. | |
| 6,098,354 | A | 8/2000 | Skandis | |
| 6,221,298 | B1 | 4/2001 | Ferreira et al. | |
| 6,233,776 | B1 | 5/2001 | Blum et al. | |
| 6,247,286 | B1 | 6/2001 | Heyns | |
| 6,372,323 | B1 | 4/2002 | Kobe et al. | |
| 6,451,400 | B1 | 9/2002 | Brock et al. | |
| 6,460,214 | B1 | 10/2002 | Chang | |
| 6,467,224 | B1 | 10/2002 | Bertolini | |
| 6,531,203 | B2 | 3/2003 | Kessler et al. | |
| 6,564,397 | B1 | 5/2003 | Hawley et al. | |
| 6,578,334 | B2 | 6/2003 | Watanabe | |
| 6,622,440 | B2 | 9/2003 | Mercade | |
| 6,623,840 | B2 | 9/2003 | Hainbach | |
| 6,647,684 | B1 | 11/2003 | Gank | |
| 6,751,912 | B2 | 6/2004 | Stegner et al. | |
| 6,802,159 | B1 | 10/2004 | Kotler | |
| 6,926,856 | B2 | 8/2005 | Hus et al. | |
| 6,966,155 | B2 | 11/2005 | Nevison | |
| 7,001,101 | B1 | 2/2006 | DeRose | |
| 7,114,298 | B2 | 10/2006 | Kotler | |
| 7,299,592 | B2 | 11/2007 | Moller, Jr. | |
| 7,507,362 | B2 | 3/2009 | Moller, Jr. | |
| 7,516,587 | B2 | 4/2009 | Barlow | |
| 7,517,483 | B2 | 4/2009 | Dalla Valle | |
| 7,543,417 | B2 | 6/2009 | McIntosh et al. | |
| 7,571,572 | B2 | 8/2009 | Moller, Jr. | |
| 7,571,573 | B2 | 8/2009 | Moller, Jr. | |
| 7,587,865 | B2 | 9/2009 | Moller, Jr. | |
| 7,610,731 | B1 | 11/2009 | Collison | |
| 7,636,960 | B2 | 12/2009 | Hawley et al. | |
| 7,690,160 | B2 * | 4/2010 | Moller, Jr. | 52/177 |
| 7,757,449 | B2 | 7/2010 | Portoles Ibanez et al. | |
| 7,793,471 | B2 | 9/2010 | Hill | |
| 7,908,802 | B2 | 3/2011 | Frederiksen | |
| 7,918,057 | B2 | 4/2011 | Moller, Jr. | |
| 7,954,295 | B2 | 6/2011 | Pervan | |
| 8,037,648 | B2 | 10/2011 | Vanderhoef | |
| D656,250 | S | 3/2012 | Forster et al. | |
| 8,141,314 | B2 | 3/2012 | Rosan | |
| 8,161,708 | B2 | 4/2012 | Schacht et al. | |
| 8,166,722 | B2 | 5/2012 | Moller, Jr. | |
| 8,266,849 | B2 | 9/2012 | Bravo et al. | |
| 8,266,857 | B2 | 9/2012 | David | |
| 8,341,896 | B2 | 1/2013 | Moller, Jr. et al. | |
| 8,397,466 | B2 | 3/2013 | Jenkins et al. | |
| 8,407,951 | B2 | 4/2013 | Haney et al. | |
| 8,439,596 | B1 | 5/2013 | Dvoracek | |
| 8,826,481 | B1 * | 9/2014 | Haydu | 14/73.5 |
| 2002/0124506 | A1 | 9/2002 | Mercade | |
| 2002/0138925 | A1 | 10/2002 | Chang | |
| 2003/0044591 | A1 | 3/2003 | Hsieh | |
| 2004/0226241 | A1 | 11/2004 | Forster et al. | |
| 2004/0226244 | A1 | 11/2004 | Graab et al. | |
| 2004/0258869 | A1 | 12/2004 | Walker | |
| 2005/0016097 | A1 | 1/2005 | Janesky | |
| 2005/0183370 | A1 | 8/2005 | Cripps | |
| 2005/0193669 | A1 | 9/2005 | Jenkins et al. | |
| 2005/0252109 | A1 | 11/2005 | Fuccella et al. | |
| 2006/0016136 | A1 | 1/2006 | Moller, Jr. | |
| 2006/0070314 | A1 | 4/2006 | Jenkins et al. | |
| 2006/0127647 | A1 | 6/2006 | Thrush | |
| 2006/0185287 | A1 | 8/2006 | Glazer et al. | |
| 2006/0272252 | A1 | 12/2006 | Moller, Jr. | |
| 2006/0283118 | A1 | 12/2006 | Moller, Jr. | |
| 2007/0184248 | A1 | 8/2007 | Pai | |
| 2008/0127593 | A1 | 6/2008 | Janesky | |
| 2008/0229697 | A1 | 9/2008 | Bosman et al. | |
| 2009/0031658 | A1 | 2/2009 | Moller, Jr. et al. | |
| 2009/0047451 | A1 | 2/2009 | Huss et al. | |
| 2009/0139159 | A1 | 6/2009 | Hill | |
| 2009/0139160 | A1 | 6/2009 | Hill | |
| 2009/0217611 | A1 | 9/2009 | Schrader | |
| 2009/0266019 | A1 | 10/2009 | McIntosh et al. | |
| 2009/0280295 | A1 | 11/2009 | Prince et al. | |
| 2009/0282769 | A1 | 11/2009 | Moller, Jr. | |
| 2010/0005757 | A1 | 1/2010 | Collison | |
| 2010/0021718 | A1 | 1/2010 | Vos et al. | |
| 2010/0236176 | A1 | 9/2010 | Jenkins et al. | |
| 2010/0300023 | A1 * | 12/2010 | Rosan | 52/302.1 |
| 2011/0056158 | A1 | 3/2011 | Moller, Jr. et al. | |
| 2011/0076457 | A1 | 3/2011 | Reichwein et al. | |
| 2011/0104434 | A1 | 5/2011 | Masanek, Jr. et al. | |
| 2012/0085043 | A1 | 4/2012 | Jenkins et al. | |
| 2012/0282440 | A1 | 11/2012 | Masanek, Jr. et al. | |
| 2013/0047528 | A1 | 2/2013 | Masanek, Jr. et al. | |
| 2013/0086861 | A1 | 4/2013 | Masanek, Jr. et al. | |
| 2013/0093115 | A1 | 4/2013 | Masanek, Jr. et al. | |
| 2013/0093116 | A1 | 4/2013 | Masanek, Jr. et al. | |
| 2013/0095291 | A1 | 4/2013 | Masanek, Jr. et al. | |
| 2013/0095295 | A1 | 4/2013 | Masanek, Jr. et al. | |
| 2013/0111836 | A1 | 5/2013 | Masanek, Jr. et al. | |
| 2013/0136899 | A1 | 5/2013 | Milella, Jr. et al. | |
| 2013/0180195 | A1 | 7/2013 | Moller, Jr. et al. | |

FOREIGN PATENT DOCUMENTS

| | | | |
|---|---|---|---|
| EP | 1514498 | A1 | 3/2005 |
| JP | S54-79715 | U | 6/1979 |
| JP | 55-65649 | U | 5/1980 |
| JP | 58-185982 | U | 12/1983 |
| JP | 59007027 | A | 1/1984 |
| JP | 218046 | A | 1/1990 |
| JP | H6-71715 | U | 10/1994 |
| JP | 9-32247 | A | 2/1997 |
| JP | 11-152882 | A | 6/1999 |
| JP | 3099100 | U | 3/2004 |
| JP | 2004-188100 | A | 7/2004 |
| JP | 2009-197447 | A | 9/2009 |
| KR | 20060005296 | A | 1/2006 |
| KR | 101184609 | B1 | 9/2012 |
| WO | 2011053710 | A1 | 5/2011 |

OTHER PUBLICATIONS

US Patent and Trademark Office Acting as the International Searching Authority, International Preliminary Report on Patentability issued in connection with International Patent Application No. PCT/US10/54515, May 1, 2012.

US Patent and Trademark Office Acting as the International Searching Authority, International Search Report issued in connection with

(56) References Cited

OTHER PUBLICATIONS

International Patent Application No. PCT/US2012/051609 on Nov. 2, 2012.
Japanese Patent Office, Notification of Reasons of Refusal issued in connection with Japanese Patent Application No. 2012-154204 on Dec. 3, 2013.
Japanese Patent Office, Notification of Reasons of Refusal issued for Japanese Patent Application No. 2012-537069 on Jun. 24, 2014.
Japanese Patent Office, Notification of Reasons of Refusal issued for Japanese Patent Application No. 2012-154195 on Jun. 24, 2014.
European Patent Office, Extended European Search Report issued on European Patent Application No. 10827475.4 on Jul. 31, 2014.

* cited by examiner 100
202a
242
222
214
210a
228
234
230
224
228
202b
240
220
212
210b 202b
220
208b
216b
204b
236
228
244
246
226
232
206
216a
202a
222
208a
204a
100

MODULAR FLOOR TILE SYSTEM WITH EXPANSION JOINT

RELATED APPLICATIONS

This application is a division of copending U.S. patent application Ser. No. 13/940,468 filed Jul. 12, 2013, owned by the assignee hereof. The specification and drawings of the foregoing application are entirely incorporated by reference herein.

BACKGROUND OF THE INVENTION

Modular floor tiles may be laid across the surfaces of garage floors, sports surfaces, outdoor surfaces and other substrates. Occasionally the floor tiles are installed in areas in which they are exposed to variations in temperature such as direct sunlight or heating and air-conditioning ducts. These temperature variations may cause the floor tiles to expand or contract. Some of the tiles may be exposed to these heating or cooling effects while others may not, leading to differential thermal expansion or contraction. In instances where the floor is installed in such a manner that it is not allowed to float or if heavy objects are placed on the floor which consequently inhibit float, the temperature variations may cause buckling or separation between the tiles.

Thus a need exists for an expansion joint that attaches to the tiles and integrates with the flooring application and accommodates floor tile expansion and contraction due to temperature fluctuations.

SUMMARY OF THE INVENTION

According to one aspect of the invention, an expansion joint is molded from thermoplastic material. The expansion joint is separable into a first and second expansion body. The first expansion body has a web with a general upper surface and a general lower surface. A plurality of edge surfaces extend from the general upper surface to the general lower surface. An outer edge surface with at least one connector is disposed on the first expansion body.

The second expansion body also has a web with a general upper and lower surface. An outer edge surface is one of the plurality of edge surfaces which extend from the general upper surface to the general lower surface. A connector is formed on the outer edge surface of the second expansion body. The connectors on the first and second expansion bodies allow the expansion joint to be connected to modular floor tiles or other expansion joints.

At least two spaced apart fingers project from the general lower surface of the first web in alignment with a direction of expansion and contraction and at least one spaced apart finger projects from the general lower surface of the second web, also in alignment with a direction of expansion and contraction. The fingers are positioned such that the second finger is slidably received into the channel defined by the first fingers.

According to another aspect of the invention, a flooring system includes plural modular floor tiles and at least one expansion joint for creating a flooring surface. Each modular floor tile has a first edge surface that has at least one first connector, and a second edge surface that has each one second connector. The modular floor tile is affixed to an adjoining modular floor tile by fastening the first connector of one tile to the second connector of the adjoining tile.

The expansion joint has first and second expansion bodies. An outer edge surface of the first expansion body includes at least one first connector that fastens to a second connector of an adjoining, first modular floor tile. The first expansion body has at least two first fingers, spaced apart from each other by at least one first channel. The first fingers are disposed below a general lower surface of a web of the first expansion body, as is the first channel. The first fingers extend beyond a first inner margin of the first expansion body, in a first direction which is aligned with a predetermined direction of expansion and contraction. Sides of the first fingers are in alignment with the predetermined direction of expansion and contraction and partially form sidewalls of the first channel.

The second expansion body has an outer edge surface with at least one second connector. The second expansion body is affixed to an adjoining, second modular floor tile by fastening its second connector to a first connector of the second modular tile. The second expansion body has at least one second finger, flanked by at least two second channels, all of which are disposed beneath a general lower surface of a web of the second expansion body. The second finger extends, in a second direction opposite the first direction, beyond an inner margin of the second expansion body. Sides of the second finger are in alignment with the predetermined direction of expansion and contraction, and form portions of sidewalls of the adjoining second channels. The first fingers will advance into and out of the second channels, and the second finger will advance into and out of the first channel, as a function of the temperature of the first and second modular tiles.

In one embodiment, each of the expansion bodies has multiple fingers interdigitated with multiple channels. In one embodiment, the modular floor tiles each have plural spaced-apart first connectors and plural spaced-apart second connectors. In this last embodiment, the first expansion body will have plural spaced-part first connectors along its outer edge surface, while the second expansion body will have plural spaced-apart second connectors along its outer edge surface.

A flooring system according to the present invention is capable of accommodating a large amount of thermal expansion and contraction of the modular tiles without separating or buckling. The present invention also permits differential expansion and contraction, in the instance where some of the modular floor tiles are at a higher temperature than others. Disposing expansion joints both longitudinally and transversely permits the accommodation of thermal expansion and contraction along each of several directions.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
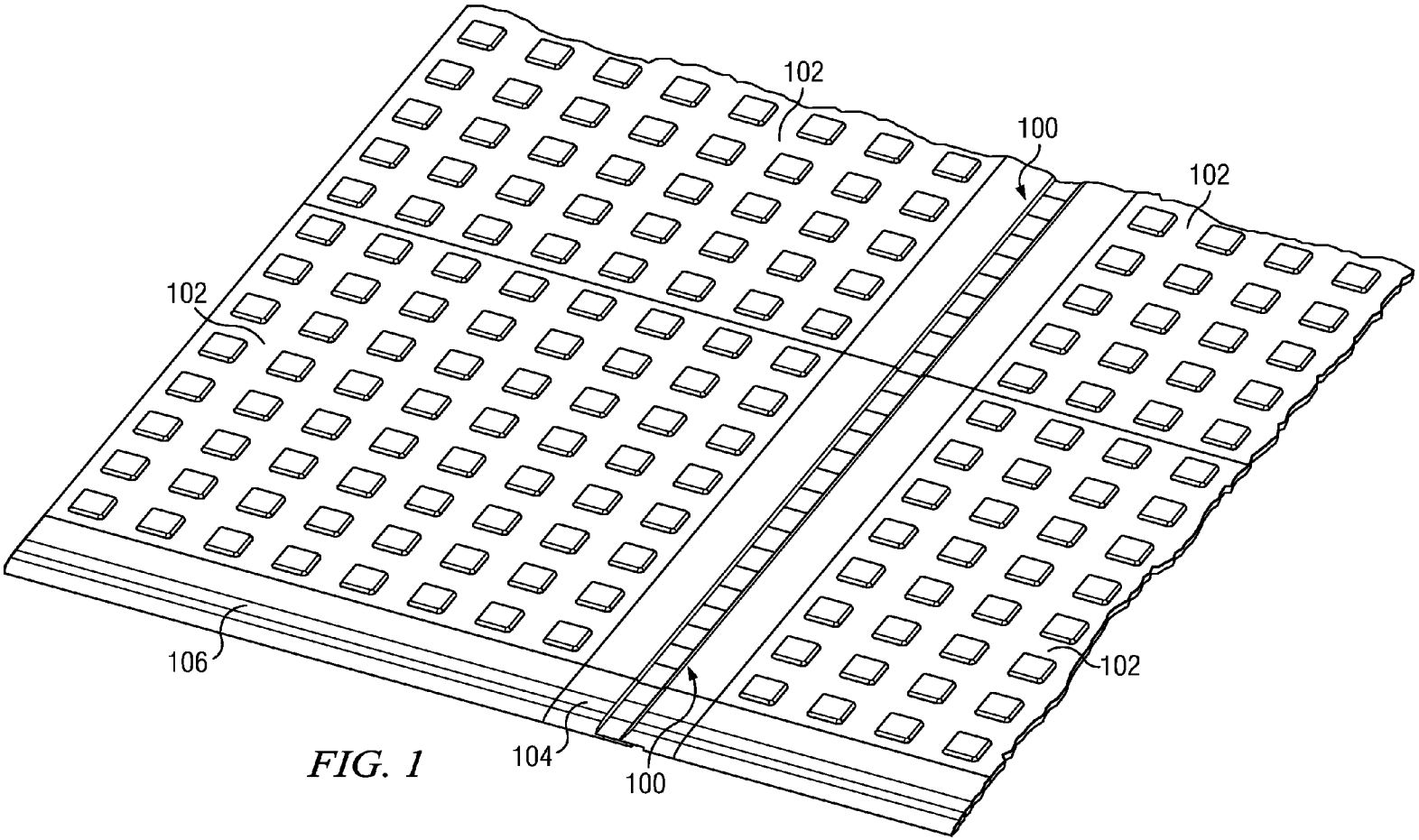
FIG. 1 is an isometric view of one embodiment of an expansion joint according to the invention, fitted between neighboring modular floor tiles.

The present invention provides an expansion joint for use in creating a floor surface of modular floor tiles where the floor surface expands and contracts, if necessary, in response to thermal variations between the tiles. The expansion and contraction of the expansion joint allows the floor surface to accommodate uneven temperature shifts across the floor thereby preventing buckling or separation. In the illustrated embodiment shown in FIG. 1, two expansion joints indicated generally at 100 are shown. The expansion joints 100 are positioned in between modular floor tiles 102. Expansion joints may be placed approximately five feet apart from each other in a modular floor tile application or system, but specific spacing will be application specific. Considerations to be taken into account when determining the placement of expansion joints include the span of the application, exposure to sunlight and heating and cooling ducts, and the placement of heavy objects such as vehicles, cabinetry and machinery. In addition, in the illustrated embodiment of FIG. 1, the expansion joints 100 are shown going in only one direction. However, expansion joints may be placed along both directions (along the x and y axis) depending on the specific application. Each expansion joint is preferably formed from a polymeric material but may also be formed from a ceramic or cellulosic material. The present invention has application to any modular floor tile system in which the modular tiles have a non-negligible coefficient of linear thermal expansion.

Figures 2A, 2B:
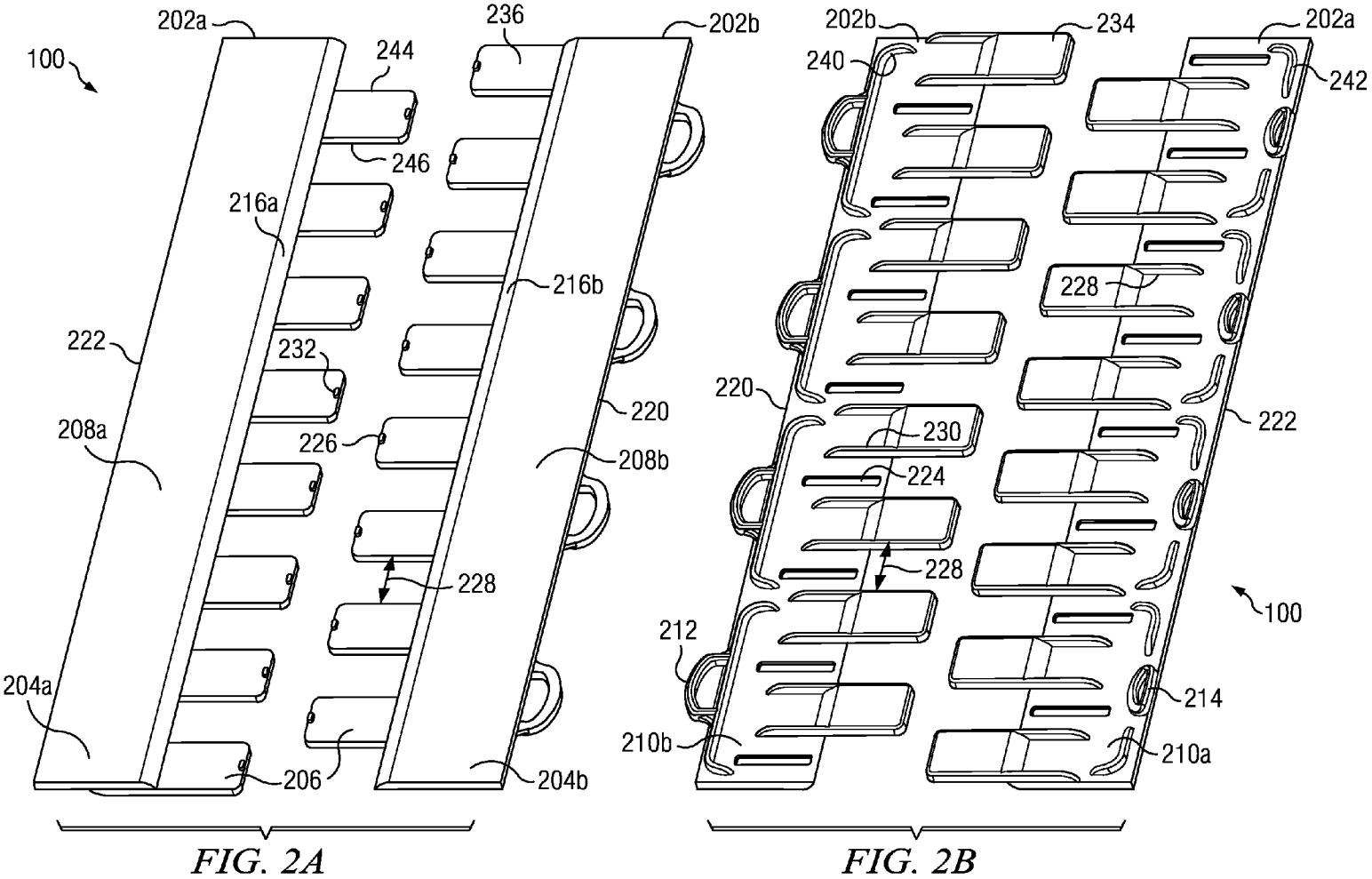
FIG. 2A is an exploded detail top view of the expansion joint shown in FIG. 1.
FIG. 2B is an exploded detail bottom view of the expansion joint shown in FIG. 1.

As shown in FIGS. 2A-2B, the expansion joint 100 consists of two expansion bodies, 202*a* and 202*b*. The first expansion body, 202*a*, has a web 204*a*, and at least two fingers 206; the illustrated embodiment shows eight fingers 206. The web 204*a* has a general upper surface 208*a*, a general lower surface 210*a* and an inner margin 216*a*. As better seen in FIGS. 5A-C, in this embodiment the inner margin 216*a* is curved in a vertical direction. In further embodiments the curvature may be different than the curvature shown in FIGS. 2A-2B. An outer edge surface 222 extends from the general upper surface 208*a* to the general lower surface 210*a* of the first expansion body 202*a*.

The second expansion body 202*b* also has a web 204*b*, and at least one finger 206; the illustrated embodiment shows eight such fingers 206. The web 204*b* has a general upper surface 208*b* and a general lower surface 210*b* and an inner margin 216*b*. The inner margin 216*b* of the second expansion body is preferably also curved in a vertical direction. In further embodiments the curvature may be different than the curvature shown in FIGS. 2A-2B. As shown in the illustrated embodiment an outer edge surface 220 on the second expansion body 202*b* extends from the general upper surface 208*b* to the general lower surface 210*b* and is opposed to the outer edge surface 222 when the expansion joint bodies 202*a*, 202*b* are connected.

Also shown in FIGS. 2A and 2B, a first connector 214 is disposed on edge surface 222 and a second connector 212 is disposed on edge surface 220. In this embodiment the first connector 214 is a latch and the second connector 212 is a loop. The loop connector 212 is designed to receive the latch connector 214, hence the expansion joint will mate with floor tiles 102 on which mating latch and loop connectors are disposed. Alternative embodiments may include a variety of connectors such that the connectors disposed on the expansion joint 100 mate with the connectors on the floor tiles 102 of the desired application.

As shown on FIG. 2B, at least two ribs 230 downwardly depend from the general lower surface 210*a* or 210*b* of the web 204*a* or 204*b*. Each rib 230 is disposed on either side of a channel 228. Each rib 230 is aligned with either a first or second side of a respective finger 206 and extends outwardly, and, in the illustrated embodiment each rib is an extension of a side surface 244, 246 of a respective finger 206. The general lower surface of each of the ribs 230 is generally co-planar with the general lower surface of the fingers 206. The ribs provide additional support and stability to the expansion joint when fully expanded. The ribs 230 also aid in guiding the mating fingers 206 into position. In alternative embodiments, the ribs may be selected to be different lengths than the length illustrated or have varied lengths among the ribs themselves.

Each channel 228 is sized to receive a finger 206 from the opposing expansion body 202*a* or 202*b*. The width of each channel 228 may be slightly greater than the width of each finger 206. Support members 240 and 242 downwardly depend from the general lower surface 210*a* or 210*b* of the web 204*a* or 204*b* and terminate on a bottom plane which is in general alignment with a bottom surface 234 of the fingers 206. The support members 240, 242 are proximate to edges 220 and 222. In the illustrated embodiment, the support members 240 and 242 downwardly depend from the lower surface of the web 210*b* to a height that is approximately equivalent to the height of the ribs 230. The placement of the support members 240, 242 may be partially determined by the placement of the connectors 212, 214. The support members 240 and 242 provide additional support, strength and stability to the expansion joint 100.

As seen in the illustrated embodiment in FIGS. 2A and 2B, the fingers 206 project from the general lower surface 210*a*, 210*b* of the web 208*a*, 208*b* and extend from the inner margins 216*a*, 216*b* in alignment with a direction of expansion and contraction (side to side in these FIGURES). Each finger has a general upper surface 236, a general lower surface 234 opposed to the general upper surface 236, a leading edge 232 joining the general upper surface 236 and general lower surface 234 and opposed to the inner margin 216*a*, 216*b*, a first side 244 joining the general upper surface 236 and general lower surface 234, and a second side 246 joining the general upper surface 236 and general lower surface 234 and opposed to the first side 244. An upstanding post 226 is disposed in close proximity to the leading edge 232 of each finger 206. The upstanding post 226, in cooperation with a groove 224 disposed in the other body in the channel 228 on the general lower surface 210*a*, 210*b*, determines the range of movement for the expansion joint 100. The groove 224 is disposed in the channel 228 in alignment with the direction of expansion and contraction. The post 226 is sized to fit into the groove 224 and the length of the groove 224 is selected such that the desired fully compressed and expanded states of the expansion joint can be achieved. In the illustrated embodiment the length of the grooves 224 is smaller than the width of the expansion bodies 202*a*, 202*b*. In alternative embodiments the placement of the upstanding post 226 may be one of several positions along the general upper surface 236 to achieve the desired range of motion and the groove 224 may be of varying lengths.

In the illustrated embodiment each finger 206 is identical in shape and size. In addition, in this embodiment, adjacent fingers 206 on each respective expansion body 202*a*, 202*b* are equidistant from each other. The width of each channel 228 is generally equivalent (or slightly greater than) to the width of an individual finger 206. In further embodiments the fingers 206 on the first expansion body 202*a* may be of varying widths and/or spacing as compared to the fingers of the second expansion body 202*b*. The sizing and spacing of the fingers 206 may vary provided the fingers 206 of the first expansion body 202*a* are accepted into the channels of the second expansion body 202*b*.

Figures 3A, 3B, 3C:
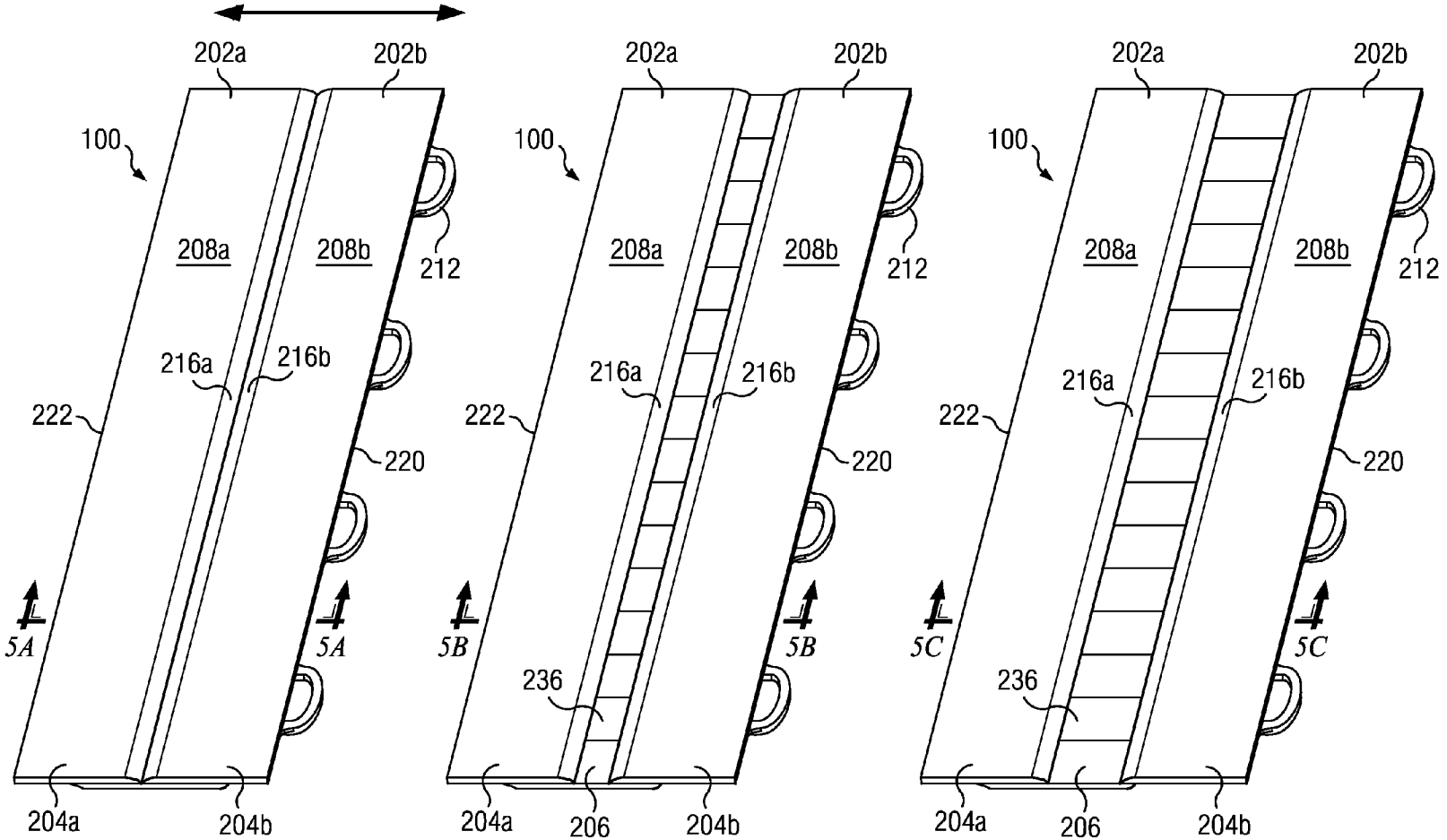
FIG. 3A is an isometric detailed view of the expansion joint shown in FIG. 1, showing two expansion joint bodies in a contracted position.
FIG. 3B is an isometric detailed view of the expansion joint shown in FIG. 3A, but in a neutral position.
FIG. 3C is an isometric detailed view of the expansion joint shown in FIGS. 3A and 3B, but in a fully expanded position.

FIGS. 3A, 3B and 3C illustrate the expansion joint 100 in three different configurations. FIG. 3B illustrates the expansion joint 100 in a neutral position with the two expansion bodies 202*a*, 202*b* joined by interlocking the fingers 206. In this illustrated embodiment the expansion joint 100 has a width of approximately 3 inches. When the expansion bodies 202*a*, 202*b*, are joined, the fingers 206 from the first expansion body 202*a* interlock with the fingers of the second expansion body 202*b*. The interlocking fingers 206 allow sliding across the width of the expansion joint yet constrain movement lengthwise and upwardly and downwardly. The interlocking fingers give the appearance of a solid tile, however, while the general height of the expansion joint web 204*a*, 204*b* is approximately equivalent to the general height of the floor tiles 102 to which the expansion joint 100 is connected, the height of the interlocking fingers 206 is lower than the general height of the expansion joint 100; the height of the fingers 206 is approximately half of the height of the modular floor tiles 102 as measured from the general upper surface 208*a,b* to the bottom plane.

FIG. 3A illustrates the expansion joint in its fully contracted position. In this configuration, the inner margin 216*a* of the first expansion body 202*a* abuts the inner margin 216*b* of the second expansion body 202*b*. In the illustrated embodiment shown in FIG. 3A the expansion joint has a width of approximately 2⅝ inches. The inner margins 216*a*, 216*b* are linear in the illustrated embodiment. Further embodiments may have inner margins 216*a*, 216*b* with curved, chamfered or other complimentary shapes. The expansion joint 100 will look like this when the adjacent tiles are relatively warm.

FIG. 3C illustrates the expansion joint 100 in a fully expanded position where it has a width of approximately 3⅜ inches. In the fully expanded position, the alternating fingers 206 completely cover the underlying floor surface. The expansion joint will look like this when the adjacent tiles are relatively cool. Alternative embodiments may include expansion joints of different widths, including variations in width of the web 204*a*, 204*b* and length of the fingers 206. Consequently, alternative embodiments may have different expansion and contraction ranges.

Figures 4A, 4B, 4C:
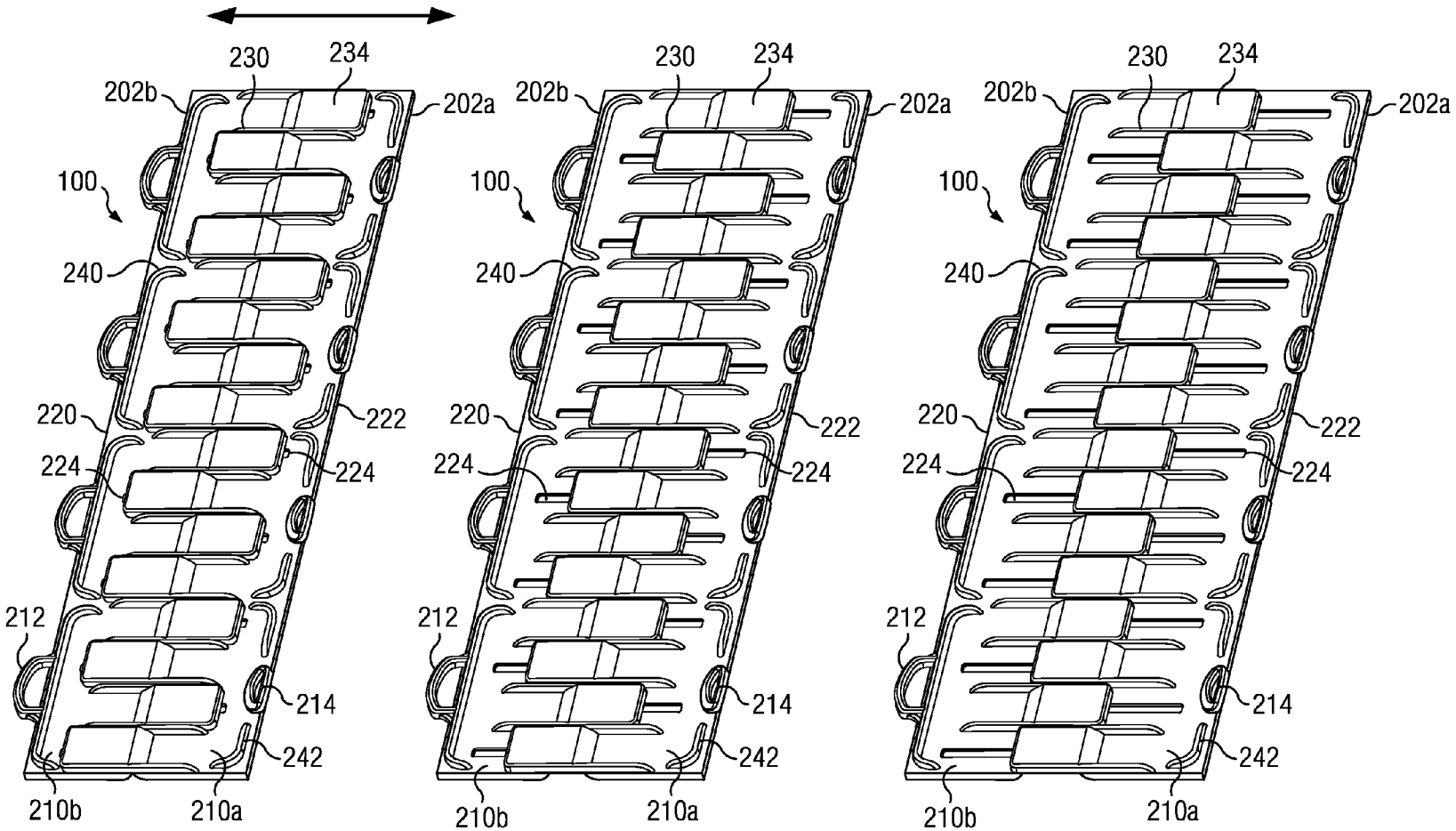
FIG. 4A is an isometric bottom view of the bottom of the expansion joint shown in FIG. 1, in a fully contracted position.
FIG. 4B is an isometric bottom view of the expansion joint shown in FIG. 4A, in a neutral position.
FIG. 4C is an isometric bottom view of the expansion joint shown in FIGS. 4A and 4B, in a fully expanded position.

FIGS. 4A, 4B, and 4C illustrate one embodiment of the bottom of the expansion joint 100. FIG. 4A illustrates the expansion joint in a fully contracted position. This view corresponds to FIG. 3A. In the embodiment shown in FIG. 4A, the fingers 206 of the first expansion body 202*a* interlock with the fingers 206 of the second expansion body 202*b*. In this fully contracted position the finger 206 extends slightly past the rib 230, however in other embodiments the length of the finger 206 and ribs 230 may vary. In addition, in the fully contracted position, each post 226 on a finger 206 is disposed at the end of a respective groove 224 farthest from the inner margin 216*a*, 216*b*; consequently the grooves 224 are not visible.

FIG. 4B illustrates the expansion joint 100 at a neutral position. This view corresponds to FIG. 3B. In this position, part of the groove 224 is visible adjacent the finger 206. FIG. 4C illustrates the expansion joint at a fully expanded position which corresponds to FIG. 3C. Here, the majority of the groove 224 is visible adjacent the finger. The ribs 230 and interlocking fingers 206 overlap minimally, if at all, in this position.

Figure 5A:
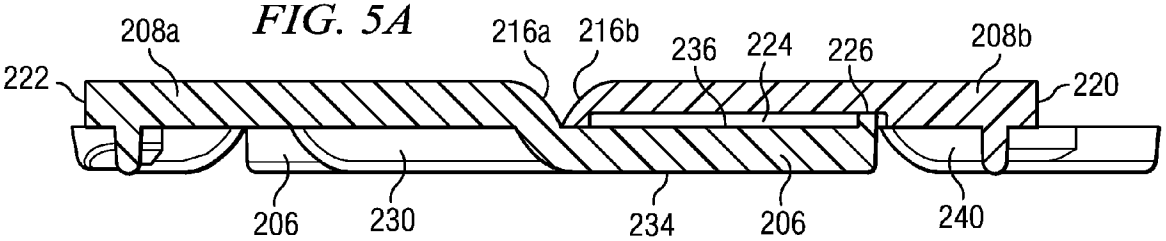
FIG. 5A is cross-sectional view taken substantially along the line 5A-5A of FIG. 3A.
Figure 5B:
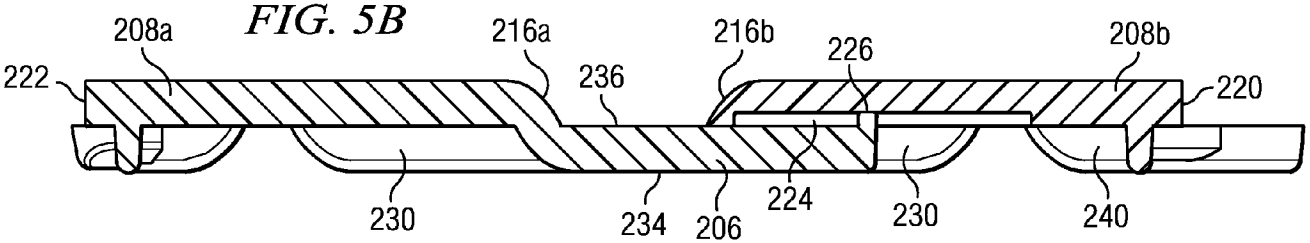
FIG. 5B is cross-sectional view taken substantially along the line 5B-5B of FIG. 3B.
Figure 5C:
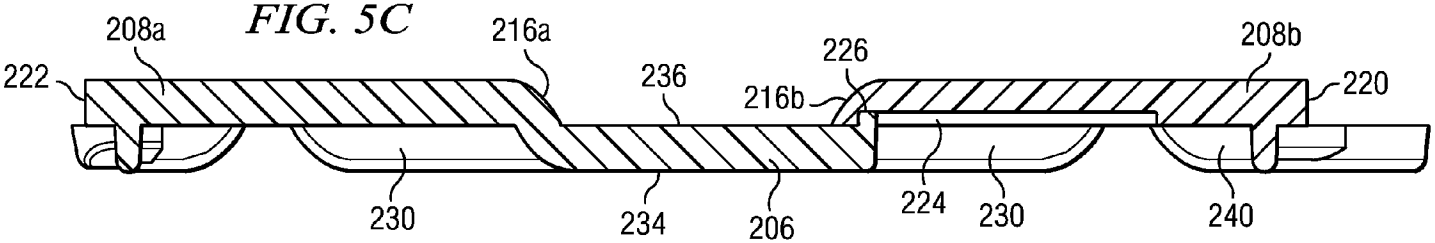
FIG. 5C is cross-sectional view taken substantially along the line 5C-5C of FIG. 3C.

FIG. 5C illustrates a cross section of the expansion joint 100 in the position of greatest expansion; this drawing corresponds to the configuration illustrated in FIGS. 3C and 4C. In this configuration, the post 226 is positioned in the groove 224 at the point closest to the inboard margin 216*b*. In other configurations the position of the post 226 and the positional relationship between the post 226 and the groove 224 may be different.

Both inner margins 216*a* and 216*b* curve downwardly toward the respective fingers 206 to help prevent cracking, sheer stresses and to promote ease of wheels or rollers rolling across the upper surface. In addition, the curved margins 216*a* and 216*b* help prevent debris buildup in the gap between the two expansion bodies 202*a*, 202*b*. The shallow faces on the inner margins 216*a*, 216*b* are easier to clean ensuring contraction will not be inhibited. The inner margin 216*b* partially overlaps the general top surface 236 of the finger 206. As illustrated in FIG. 5A the finger 206 and the ribs 230 have generally equivalent heights, maintaining the expansion bodies 202*a*, 202*b* at a generally constant height. The finger 206 extends across the entire distance between the inner margins 216*a* and 216*b* which provides full coverage of the floor surface below the expansion joint.

The illustrated embodiment of FIG. 5B is a cross section of the expansion joint in a neutral position, neither expanded nor contracted; this drawing corresponds to FIGS. 3B and 4B. In this embodiment the post 226 is disposed in approximately the midpoint of groove 224, hence the expansion body 202*b* partially overlaps the finger 206.

The illustrated embodiment of FIG. 5A is a cross section of the expansion joint in an contracted position; this drawing corresponds to FIGS. 3A and 4A. In this embodiment, the post 226 is positioned in the groove 224 at the position furthest from the inboard margin 216*b*. Further, in this embodiment, the inner margin 216*a* abuts the inner margin 216*b*.

Figure 6:
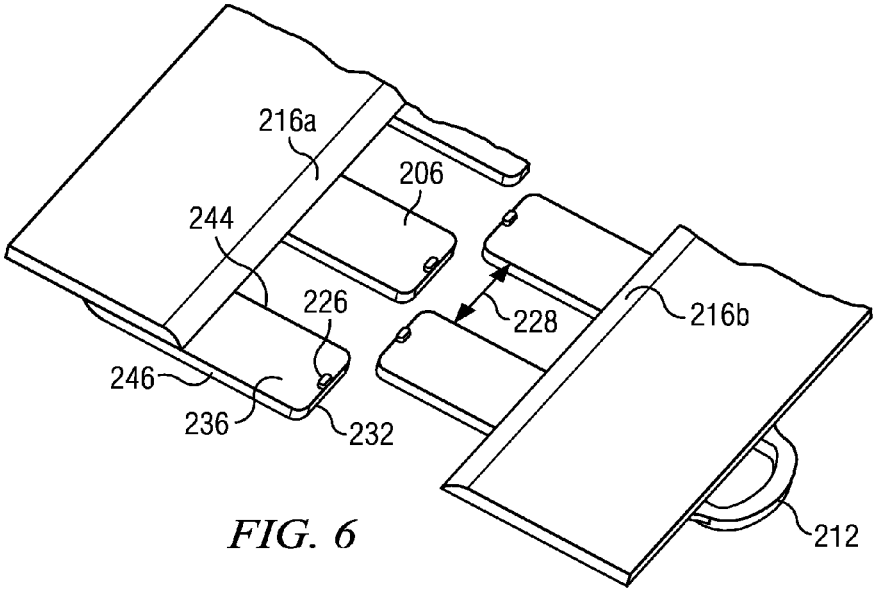
FIG. 6 is a detailed exploded top view of a portion of an expansion joint shown in FIG. 2A.

The post 226 is shown in greater detail in FIG. 6. In this embodiment the post 226 is disposed on the top surface 236 of the finger 206, near the leading edge 232 of the finger 206. The post 226 is sized to be accepted into the groove 224 which is shown in a detail view in FIG. 7. In this embodiment the groove 224 is disposed on the general lower surface 210*a*, 210*b* of the expansion body 202*a*, 202*b*. The position of the post 226 and the position and length of the groove 224 determine the amount of expansion and contraction the expansion joint will be able to accomplish. In further embodiments, the post 226 may be placed on the general lower surface of the expansion body 202*a*, 202*b* with the groove 224 on the general upper surface of the finger 206. In addition, the post 226 may be located on different areas of the finger 206 providing that the groove 224 is properly placed to ensure the desired expansion and contraction. The fit of the post 226 in the groove 224 is such that the separation of the joint is prevented.

Figure 7:
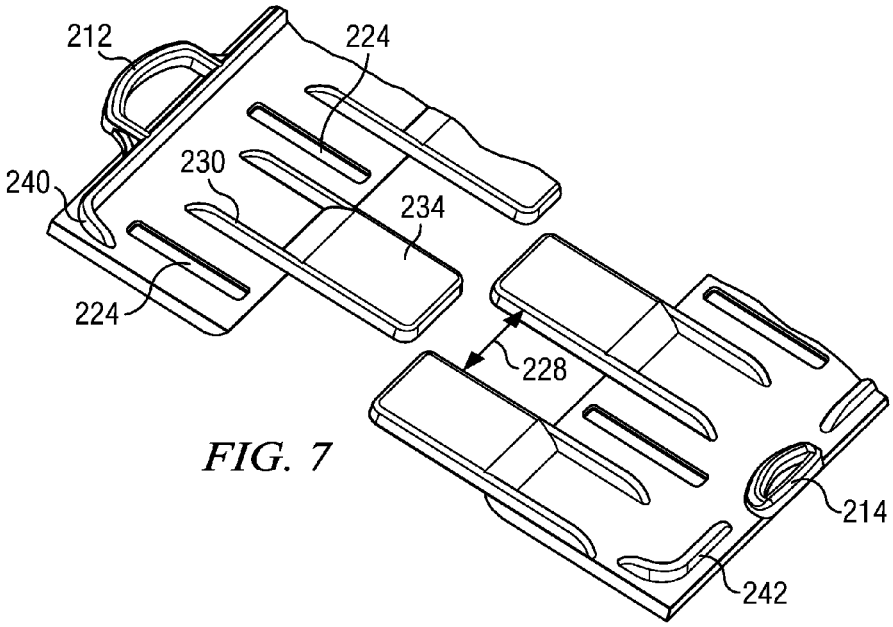
FIG. 7 is a detailed exploded bottom view of a portion of an expansion joint channel shown in FIG. 2B.

In the embodiment shown in FIG. 7, the groove is centered in the channel 228 that is situated between adjacent fingers 206. The length of the channel, in relation to the position of the post 226 on the finger 206, determines the maximum displacement of the expansion bodies 202*a*, 202*b*, during expansion and contraction.

Figure 8:
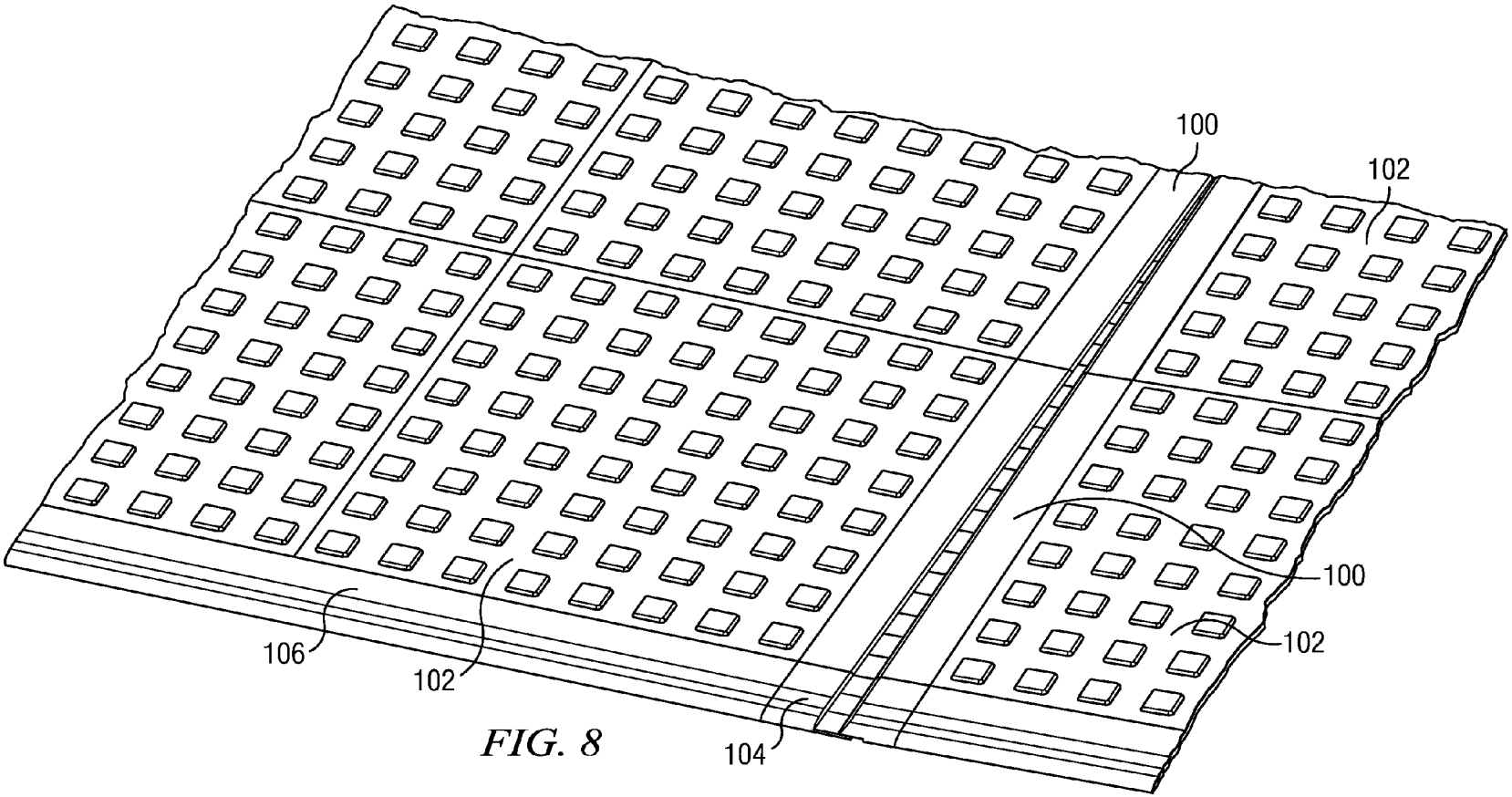
FIG. 8 is an isometric view of a floor tile system, showing differential thermal expansion of the floor tiles and the effects thereof on two expansion joints.

When multiple expansion joints 100 are used across a large floor area, the individual expansion joints 100 may expand or contract by different amounts. For example, if part of a floor tile application is in the sun while the opposed portion is under a cold air vent, the expansion joints in the sun may experience contraction as the tiles around them expand, while the expansion joints in the cold air may experience expansion as the tiles around them shrink. Thus, the floor of tiles may experience an expansion as shown in FIG. 8. This "V" expansion is accommodated by the design of the fingers 206. The width of the fingers 206 is slightly smaller than the width of the channels 228, permitting a slight difference in the displacement vector from the direction of expansion and contraction.

The expansion joints 100 are positioned in between modular floor tiles 102 which are molded of at least a first polymer; in further embodiments floor tiles may be molded of a first and second polymer. The floor tiles have bodies with horizontal, substantially planar webs with upper and lower surfaces. The floor tiles each have a first and second edge surface and connectors disposed on the edge surfaces of the tiles. The floor tile connectors mate with the connectors on the expansion joint; in some embodiments the connectors may be mating latch and loop connectors.

Figure 9:
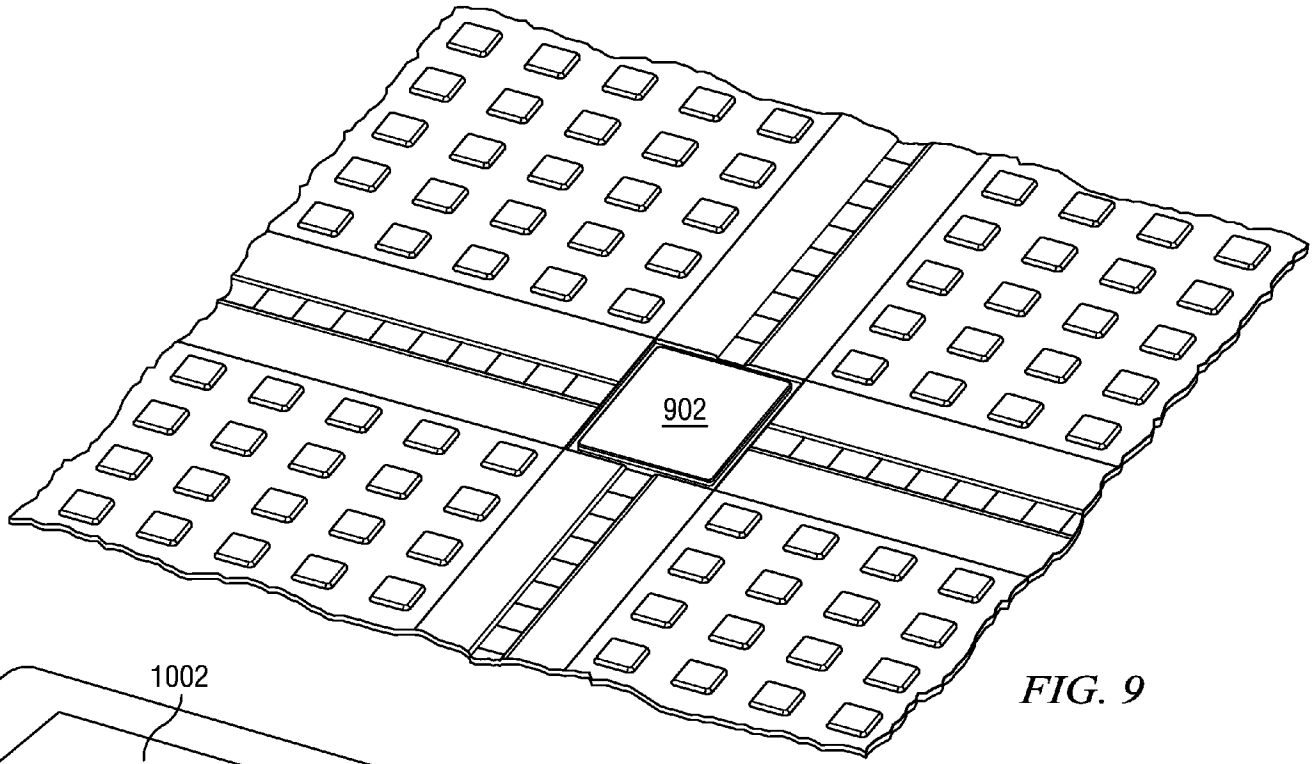
FIG. 9 is an isometric view of a filler piece according to the invention, fitted to modular floor tiles and expansion joints.
Figure 10:
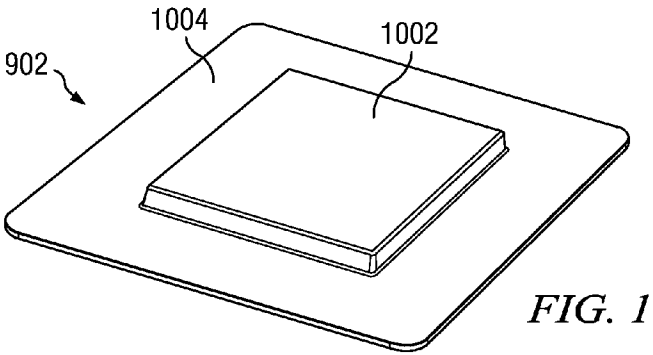
FIG. 10 is a detail view of the filler piece shown in FIG. 9.

As discussed above, certain installations may have expansion joints installed at an angle to one another, preferably a right angle. In these cases a filler piece 902 is used at the intersection of the bidirectional expansion joints as illustrated in FIG. 9. In the embodiment shown in FIG. 10, the filler piece 902 has a raised approximately square puck or platform 1002 with a surrounding flange or platform 1004. The length and width of the raised puck 1002 is sized to fit in the intersection of the expansion joints 100 when both directions of expansion joints 100 are at the contracted configuration (see FIG. 3A). The height of the raised puck 1002 corresponds to the approximate height of general upper surface 208*a*, 208*b* of the expansion joint bodies 202*a*, 202*b*. When both expansion joints 100 adjacent to the filler piece 902 expand, the flange 1004 of the filler piece 902 will be exposed. In the illustrated embodiment shown in FIG. 9, the underlying floor will not be visible, even when the adjacent expansion joints 100 are fully expanded.

Figure 11A:
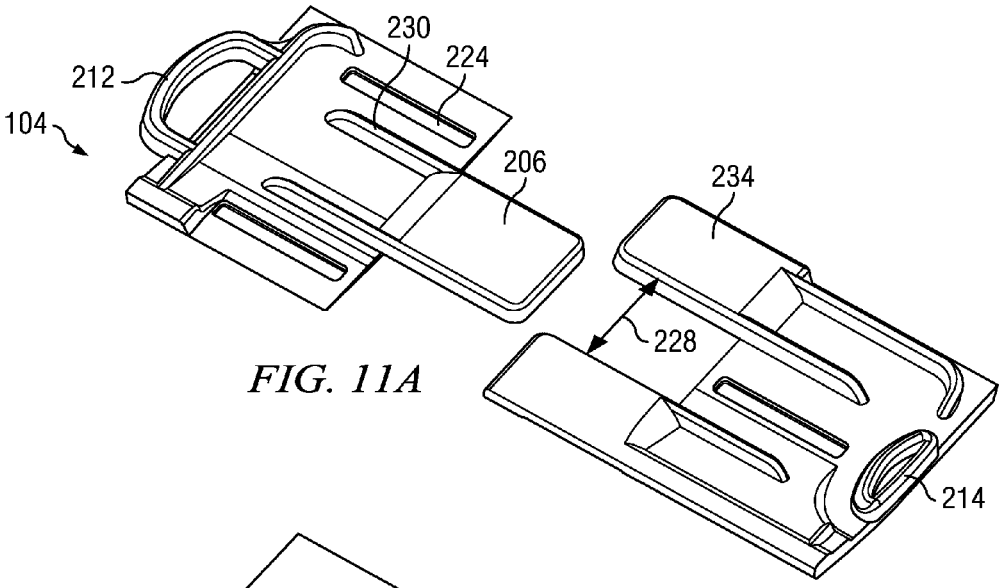
FIG. 11A is a detailed exploded bottom view of a border piece shown in FIG. 8.
Figure 11B:
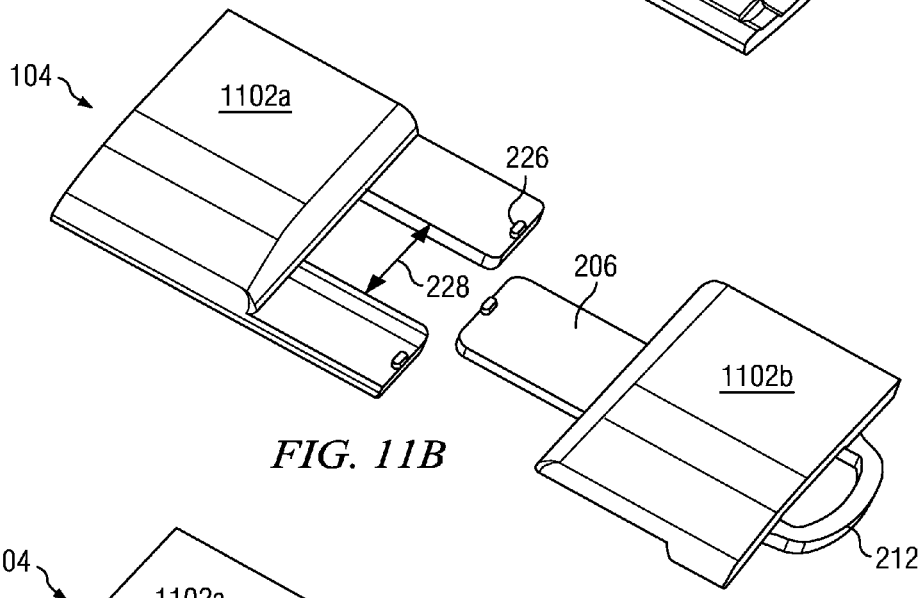
FIG. 11B is a detailed exploded top view of a border piece shown in FIG. 8.
Figure 11C:
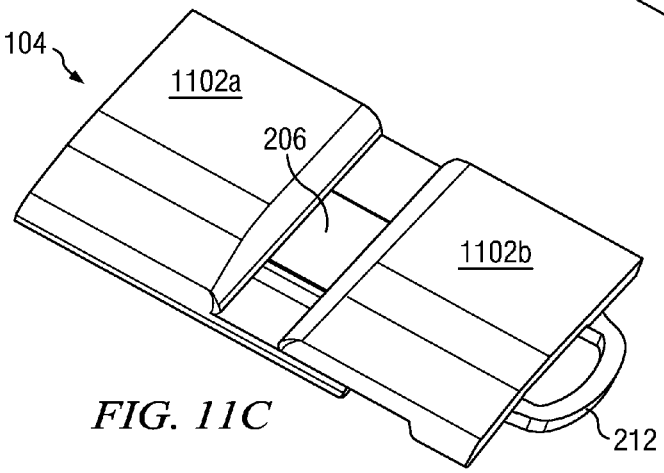
FIG. 11C is a detailed view of a border piece in an assembled, expanded position.

In addition, in some applications, the modular floor tiles are connected to "border" pieces 106 that are placed around the outer-most tiles of the application. In these instances, an expansion joint border piece 104 may be used to join the tile borders 106 and provide a continuous outer edge. As shown in FIGS. 11A-C the expansion joint border piece 104 is similar to the regular expansion joint. The primary difference is that the expansion bodies 1102*a*, 1102*b* have an angled end that matches the angle on the other border pieces.

In summary, a flooring system has been shown and described which uses interdigitated expansion joints to accommodate the thermal expansion and contraction of the modular floor tiles making up the flooring system. While embodiments of the present invention have been described and illustrated in the appended drawings, the present invention is not limited thereto but only by the scope and spirit of the appended claims.

We claim:

1. A flooring system including a plurality of modular floor tiles and at least one floor tile expansion joint for use in creating a flooring surface on an underlying surface, the system comprising:

a plurality of modular floor tiles molded of at least a first polymer, the modular floor tiles including a first modular floor tile and a second modular floor tile, each modular floor tile having a body with a horizontal, substantially planar web with an upper surface and a general lower surface;

each modular floor tile having a first edge surface that extends from the upper surface of the modular floor tile to the general lower surface of the modular floor tile, and a second edge surface that extends from the upper surface of the modular floor tile to the general lower surface of the modular floor tile, the first edge surface having at least one first connector and the second edge surface having at least one second connector, the first connector of one modular floor tile fastening to a second connector of an adjacent modular floor tile to affix said one modular floor tile to the adjacent modular floor tile;

the expansion joint including first and second expansion bodies, the first expansion body having a first web with a first general upper surface and a first general lower surface, a plurality of first edge surfaces of the first expansion body including a first outer edge surface, the first edge surfaces extending from the first general upper surface of the first expansion body to the first general lower surface of the first expansion body, the first outer edge surface of the first expansion body including at least one first connector fastened to a second connector of the first modular floor tile, the first expansion body having a first inner margin opposed to the first outer edge surface, at least two spaced-apart first fingers of the first expansion body disposed below the general lower surface of the first expansion body and extending beyond the first inner margin in a first direction in alignment with a predetermined direction of expansion and contraction, each of the first fingers having sides in alignment with the predetermined direction of expansion and contraction, a first channel spacing apart the first fingers and extending below the general lower surface of the first web, sides of the first fingers forming portions of respective sidewalls of the first channel;

the second expansion body of the expansion joint having a second web with a second general upper surface and a second general lower surface, a plurality of second edge surfaces of the second expansion body extending from the second general upper surface of the second expansion body to the second general lower surface of the second expansion body, the second edge surfaces of the second expansion body including a second outer edge surface, the second outer edge surface of the second expansion body including at least one second connector fastened to a first connector of the second modular floor tile, the second expansion body having a second inner margin opposed to the second outer edge, at least one second finger of the second expansion body disposed below the second general lower surface of the second expansion body and extending beyond the second inner margin in a second direction that is opposite the first direction, sides of the second finger being in alignment with the predetermined direction of expansion and contraction, the second expansion body having at least two second channels disposed beneath the second general lower surface, sides of the said at least one second finger forming portions of respective sidewalls of said least two channels; wherein the first fingers advance into and retract out of the second channels, and said at least one second finger advances into and retracts out of said at least one first channel, as a function of the temperature of the first and second modular tiles.

2. The system of claim 1, wherein the first channel of the first expansion joint body is one of a plurality of first channels, adjacent ones of the first channels being spaced apart by a first finger, said at least one second finger of the second expansion body being one of a plurality of second fingers, the second fingers received into respective ones of the first channels, a second channel spacing apart adjacent ones of the second fingers.

3. The system of claim 1, wherein each of the first fingers has a first side and a second side parallel to the first side, for each last said first and second sides, a rib downwardly depending from the first general lower surface of the first expansion body, the last said rib being in alignment with the last said side and extending outwardly therefrom, sidewalls of the first channel being formed by sides of the first fingers and associated ribs;

said at least one second finger having a first side and a second side parallel to the first side, for each last said first and second sides, a rib downwardly depending from the second general lower surface of the second expansion body, the last said rib being in alignment with the last said side and extending outwardly therefrom, sidewalls of the second channels being formed by sides of said least one second finger and associated ribs.

4. The system of claim 1, wherein the plurality of modular floor tiles are molded of at least a first and a second polymer.

5. The system of claim 1, wherein a preselected one of the first and second connectors is a loop, the other of the first and second connectors being a latch for fastening into the loop.

6. The system of claim 1, wherein the first edge surfaces of the first and second modular floor tiles each have a plurality of spaced-apart first connectors, the second edge surfaces of the first and second modular floor tiles each having a plurality of spaced-apart second connectors, the outer edge surface of the first expansion body having a plurality of spaced-apart first connectors, the outer edge surface of the second expansion body having a plurality of spaced-apart second connectors.

7. The system of claim 1, wherein the first outer edge surface of the first expansion body is fixed to the first modular floor tile, the second outer edge surface of the second expansion body being fixed to the second modular floor tile.

8. The system of claim 1, wherein a width, in a horizontal direction orthogonal to said predetermined direction of expansion and contraction, of said at least one first channel is greater than a width, in a horizontal direction orthogonal to said predetermined direction of expansion and contraction, of said at least one second finger, such that the expansion joint may accommodate non-uniform thermal expansion and contraction of the plurality of modular floor tiles.

9. The system of claim 1, wherein widths, in a horizontal direction orthogonal to said predetermined direction of expansion and contraction, of the first and second fingers are uniform.

10. The system of claim 1, wherein each of the modular floor tiles has a general upper surface, a plurality of support members extending from the general lower surface of the web of the modular floor tile to a support plane, a tile thickness defined to extend between the general upper surface of the modular floor tile and the support plane of the modular floor tile;

the first fingers each having a first finger thickness between the first general upper surface of the last said first finger and the first general lower surface of the last said first finger, the second fingers each having a second finger thickness between the second general upper surface of the last said second finger and the second general lower surface of the last said second finger, the first and second finger thicknesses being less than the tile thickness.

11. The system of claim 1, further including a third edge surface disposed on the first modular floor tile, the third edge surface extending at an angle from the first edge surface, the plurality of modular floor tiles including a third modular floor tile having a fourth edge surface and a fifth edge surface extending at an angle from the fourth edge surface, the system further including a second expansion joint similar to the first expansion joint, the second expansion joint connecting together the third and fourth edge surfaces.

12. The system of claim 11, wherein the plurality of modular floor ties further includes a fourth modular floor tile having a sixth edge surface and a seventh edge surface, an eighth edge surface of the second modular floor tile extending at an angle from the first edge surface of the second modular floor tile; and a third and a fourth expansion joint each similar to the first expansion joint, the third expansion joint connecting together the fifth and sixth edges, the fourth expansion joint connecting together the seventh and eighth edges.

13. The system of claim 12, further including a filler piece disposed at the intersection of a plurality of expansion joints, the filler piece including a step and a platform, the platform having outside edges dimensioned such that the first, second, third and fourth expansion joints are able to achieve a fully contracted position while the underlying surface remains fully covered, the step extending upwardly from the platform, the step having walls dimensioned such that the adjacent expansion joints are able to achieve a fully expanded position.

14. The system of claim 13, wherein the step of the filler piece has the shape of a square.

15. The system of claim 1, further including a first sloped border attached to the first modular floor tile, a second sloped border attached to the second modular floor tile, an expansion joint border attaching to each of the first and the second sloped borders, the expansion joint border having a first web and a second web, the first web having a first border general lower surface, at least two spaced-apart first fingers projecting from the first border general lower surface and extending in alignment with the direction of expansion and contraction, the second web having a second border general lower surface, at least one second finger projecting from the second border general lower surface and extending in alignment with the direction of expansion and contraction, the first fingers spaced apart by a channel slidably receiving the second finger.

16. The system of claim 1, wherein each of the first and second fingers has a length parallel to the predetermined direction of expansion and contraction and a width perpendicular to the predetermined direction of expansion and contraction, the length of each of the first and second fingers being greater than its width.

17. The system of claim 1, wherein the first and second inner margins are curved in a vertical direction.

18. The system of claim 1, wherein the first expansion body includes a plurality of first support members downwardly depending from the first general lower surface of the first expansion body, the first support members being disposed near the first outer edge surface of the first expansion body, the second expansion body including a plurality of second support members downwardly depending from the second general lower surface of the second expansion body, the second support members being disposed near the second outer edge surface of the second expansion body.

19. The system of claim 18, wherein each finger has a length in the predetermined direction of expansion and contraction and each support member has a width in the direction of expansion and contraction, a width in the last said predetermined direction of the respective expansion body being greater than the sum of the last said finger length and the support member width.

* * * * *